US010954699B2

(12) United States Patent
Pare

(10) Patent No.: US 10,954,699 B2
(45) Date of Patent: Mar. 23, 2021

(54) SECURITY DEVICE FOR TRAILER DOORS

(71) Applicant: Andre Pare, St-Charles-de-Drummond (CA)

(72) Inventor: Andre Pare, St-Charles-de-Drummond (CA)

( * ) Notice: Subject to any disclaimer, the term of this patent is extended or adjusted under 35 U.S.C. 154(b) by 85 days.

(21) Appl. No.: 15/731,954

(22) Filed: Aug. 31, 2017

(65) Prior Publication Data

US 2018/0313110 A1 Nov. 1, 2018

(30) Foreign Application Priority Data

Apr. 28, 2017 (CA) ..... 2965653

(51) Int. Cl.
*E05B 83/10* (2014.01)
*E05B 13/00* (2006.01)
*E05B 65/48* (2006.01)

(52) U.S. Cl.
CPC ..... *E05B 83/10* (2013.01); *E05B 13/001* (2013.01); *E05B 13/002* (2013.01); *E05B 65/48* (2013.01)

(58) Field of Classification Search
CPC .... E05B 13/001; E05B 13/002; E05B 13/008; E05B 65/0003; E05B 65/06; E05B 65/48; E05B 83/02; E05B 83/08; E05B 83/10; E05B 67/00; E05B 67/22; E05B 67/24; E05B 15/02; E05B 15/0205; E05C 1/002; E05C 1/08; E05C 1/085
See application file for complete search history.

(56) References Cited

U.S. PATENT DOCUMENTS 558,623 A * 4/1896 Taylor ..... E05B 67/24 70/38 A
864,743 A * 8/1907 Jonson ..... E05B 67/24 70/38 B
1,246,472 A * 11/1917 Salvatore ..... E05B 67/24 70/38 A
1,579,632 A * 4/1926 Best ..... E05B 67/24 70/38 A
2,116,965 A * 5/1938 Schoorel et al. ..... E05B 67/24 70/361
2,409,424 A * 10/1946 Falk ..... E05B 67/24 70/38 A
2,726,531 A * 12/1955 Vile ..... E05B 67/24 70/38 B
2,867,110 A * 1/1959 Foote ..... E05B 67/24 70/38 B (Continued)

*Primary Examiner* — Christopher J Boswell
(74) *Attorney, Agent, or Firm* — Eric Fincham

(57) ABSTRACT

A security device for a trailer door which has a rotatable post for a locking door and a bar member secured to the post, the security device comprising a plate member for securement to a substrate, a cover hingedly connected to the plate member and movable between an open and closed position, a locking device mounted at one end of the cover, the locking device having a housing, a plunger mounted within the housing, the plunger being movable between an extended position and a retracted position, the plunger being spring biased to the extended position, and a deflector extending upwardly from the plate member, the deflector having an aperture formed therein, the plate member being located such that the plunger enters the aperture when the cover is in a closed position.

5 Claims, 17 Drawing Sheets

(56) References Cited

U.S. PATENT DOCUMENTS 3,068,682 A * 12/1962 Russell ..... E05B 67/24 70/38 A
3,187,525 A * 6/1965 Dies ..... E05B 67/24 70/368
3,613,409 A * 10/1971 Paioletti ..... E05B 67/24 70/208
3,792,887 A * 2/1974 Ramsey ..... E05C 1/08 292/169.21
3,907,347 A * 9/1975 Hollis ..... E05C 1/08 292/169.13
4,015,454 A * 4/1977 Struble ..... E05C 1/08 70/2
4,033,156 A * 7/1977 Cottingham ..... E05B 17/002 70/56
4,898,008 A * 2/1990 Eberly ..... E05B 67/38 292/DIG. 32
5,118,149 A * 6/1992 Emmons ..... E05B 13/002 292/205
5,168,258 A * 12/1992 Radke ..... E05B 67/38 340/542
5,186,029 A * 2/1993 Myers ..... E05B 67/24 70/371
5,377,511 A * 1/1995 Meckbach ..... E05B 67/063 70/371
5,524,944 A * 6/1996 Berg ..... E05B 67/383 292/148
5,896,761 A * 4/1999 Chen ..... E05B 67/24 70/367
5,975,595 A * 11/1999 Lorenzo ..... E05B 67/38 292/205
6,010,166 A * 1/2000 Hamilton ..... E05B 13/002 292/282
6,425,274 B1 * 7/2002 Laitala ..... E05B 67/24 70/279.1
7,210,316 B1 * 5/2007 Falconer ..... E05B 13/002 292/218
7,278,284 B1 * 10/2007 James ..... E05B 13/002 292/205
8,935,944 B2 * 1/2015 Boesel ..... E05B 65/48 292/285
9,032,765 B2 * 5/2015 Boesel ..... E05B 13/002 292/285
9,562,374 B1 * 2/2017 Haber ..... E05B 83/14
10,385,596 B2 * 8/2019 Nakanishi ..... E05B 83/34
2004/0221626 A1 * 11/2004 Palzkill ..... E05B 13/002 70/34

* cited by examiner

SECURITY DEVICE FOR TRAILER DOORS

FIELD OF THE INVENTION

The present invention relates to a security device and more particularly, relates to a security device to be used with the doors of a trailer.

BACKGROUND OF THE INVENTION

Trailers for towing behind a vehicle are well known in the art. They come in various sizes and configurations and range from small trailers utilized by consumers to larger trailers which are typically utilized by contractors. Trailers are typically used for carrying parts and tools which a contractor will typically require when working on site.

An extremely prevalent problem which presents itself to most contractors is the theft of equipment from the trailer. Such thefts can occur if the trailer is left on site unsupervised, such as may occur during the overnight hours or even during working hours.

There are different known arrangements for locking the trailers. One popular arrangement is one wherein a vertically extending bar locks into both the top and bottom frames of the trailer proximate the door opening. In such an arrangement, there is provided a horizontal bar which is used to rotate the vertical post into and out of a locking relationship with the trailer. The horizontal bar is then typically secured between two hasps, at least one of which is movable to allow movement of the bar to rotate the vertical post. The two hasps are typically secured together by means of a lock.

Problems arise with respect to the above arrangement. Thieves have become very adept at picking such locks or just cutting them off to gain access to the contents of the trailer. Furthermore, often the lock is not securely fixed due to the inattention or laziness of employees accessing the trailer.

It would therefore be desirable to have a security device which overcomes the above recited problems and which security device is easy to use and would automatically lock the trailer doors once activated.

SUMMARY OF THE INVENTION

According to one aspect of the present invention, there is provided a security device for a trailer door, the security device having a rotatable post for locking the door, a bar member attached to the post, the security device comprising a plate member for securement to a substrate, a cover hingedly connected to the plate member and movable between an open and closed position, a locking device mounted at one end of the cover, the locking device having a housing, a plunger mounted within the housing, the plunger being movable between an extended position and a retracted position, the plunger being spring biased to the extended position, and a deflector extending upwardly from the plate member, the deflector having an aperture formed therein, the plate being located such that the plunger enters the aperture when the cover is in a closed position.

Typically, the known trailers are secured by inserting a lock between two hasps, which lock a horizontal bar used to rotate a vertical post between locked and unlocked positions.

The security device of the present invention functions to prevent access to the hasps. The device will include a member enclosing the hasps and which member is formed of a suitable material such as stainless steel.

In greater detail, the security device utilizes a plate member which is secured to a substrate. Typically, the substrate will be the door itself although some arrangements could utilize a portion of the trailer wall.

The cover is hingedly connected to the plate member and is movable between open and closed positions. In the open position, access is provided through the hasp and bar member to lock or unlock the door as desired. In the closed position, access to the hasp is denied and the trailer is secured.

The cover is preferably designed to have its hinge arranged at the upper portion of the cover. The hinge arrangement is preferably one wherein the cover may be maintained in the open position without human intervention. A number of arrangements can be used including one wherein the hinge and cover, when in the fully open position, require a greater than normal effort to close the cover.

The cover preferably includes an interior wall to form a compartment therein. A sealing material may be utilized such that when the cover is in a closed position, a moisture impermeable barrier is formed to prevent moisture entering the compartment.

The locking device is mounted in one end of the cover, the locking device having a housing with a plunger mounted within the housing. The plunger is movable between the extended position and the retracted position with the plunger being spring biased to the extended position.

The deflector extends upwardly from the plate member and has an aperture formed therein. Preferably, the plate member has an angled portion which will contact the plunger when the cover is moved from the open to closed position. This will allow the plunger to be guided downwardly where it will enter an aperture formed in the deflector.

The locking device is of the push-pull type wherein once a key is entered therein, an inner housing containing the plunger may be retracted. This will permit opening of the cover and access to the bar member. Also, the arrangement is such that the cover can be moved to the closed and locked position without requiring the key.

BRIEF DESCRIPTION OF THE DRAWINGS

Having thus generally described the invention, reference will be made to the accompanying drawings illustrating embodiments thereof, in which.

DETAILED DESCRIPTION OF THE INVENTION

Figure 1:
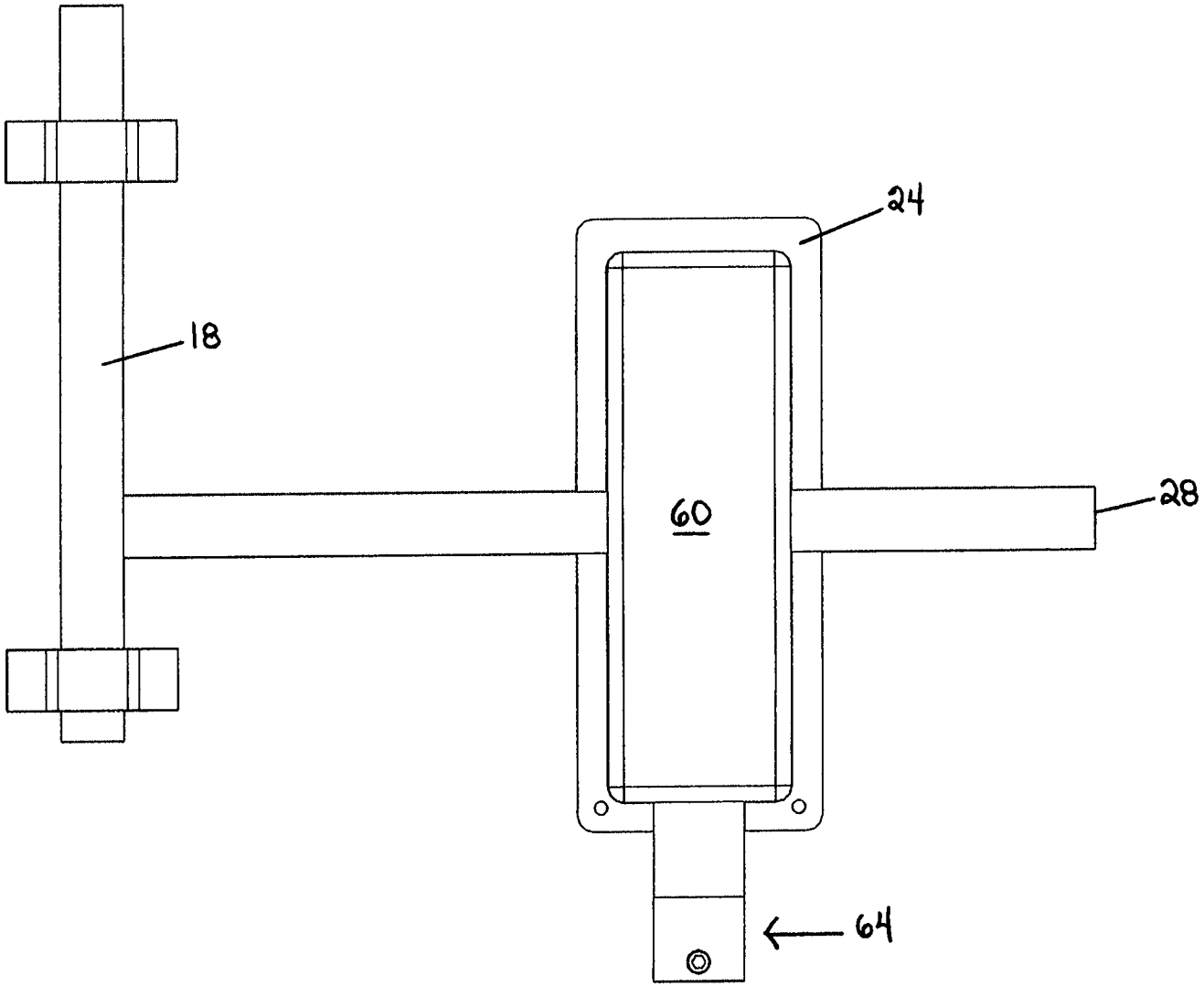
FIG. 1 is an elevational view illustrating a security device according to one aspect of the present invention.
Figure 2:
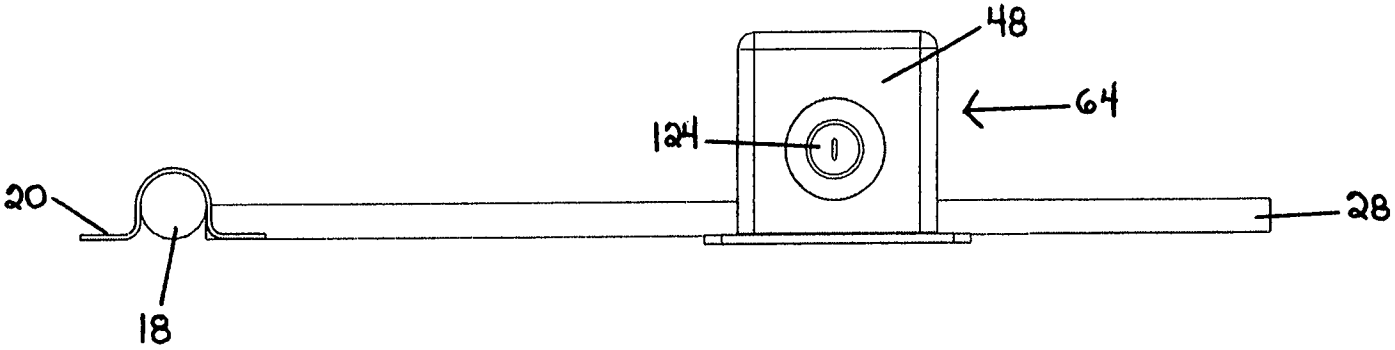
FIG. 2 is a bottom plan view thereof.
Figure 3:
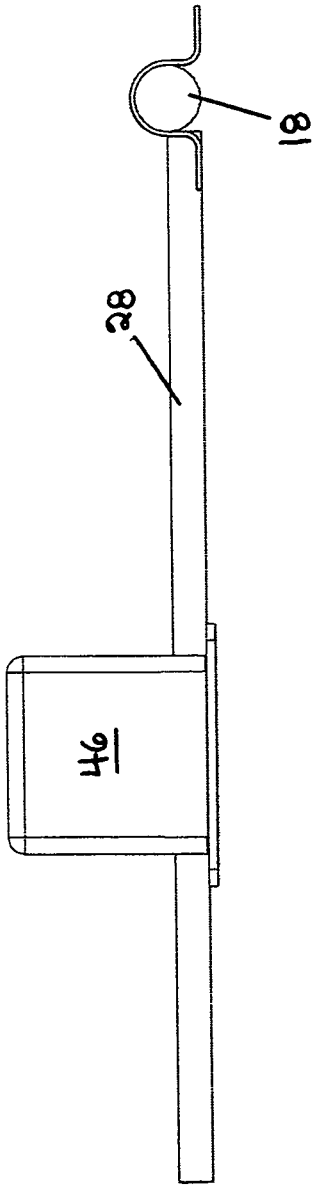
FIG. 3 is a top plan view thereof.
Figure 4:
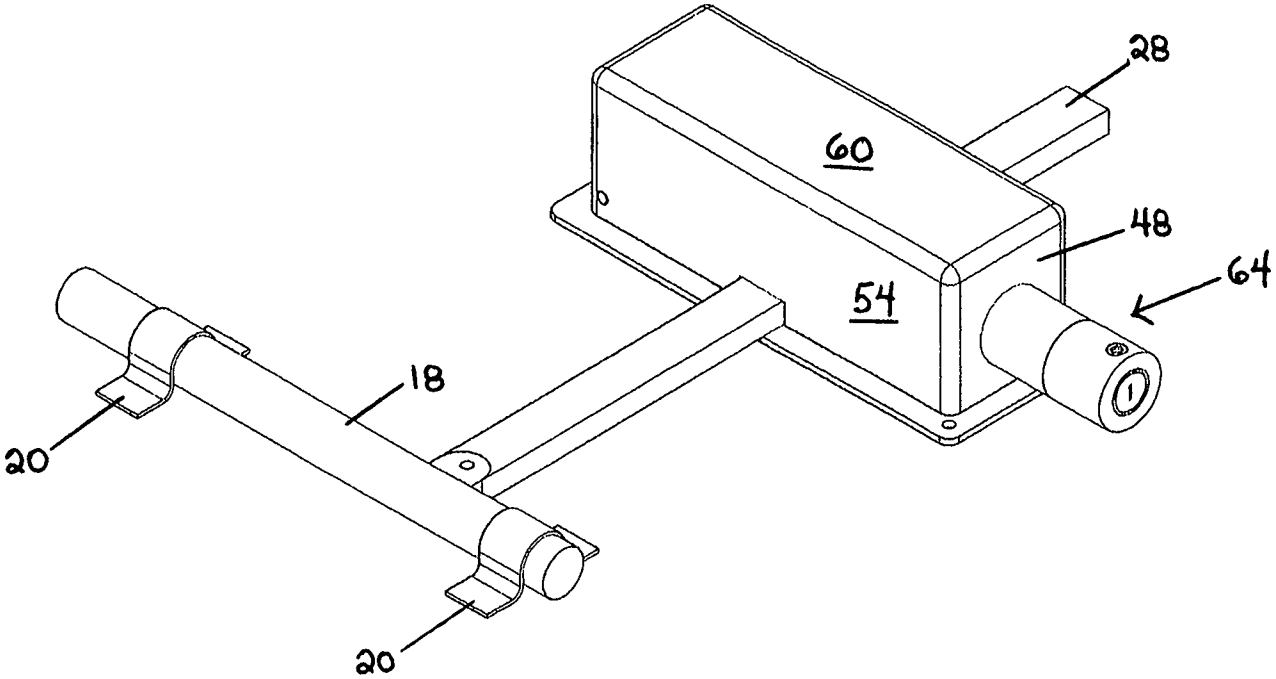
FIG. 4 is a perspective view of the security device in a locked position.
Figure 5:
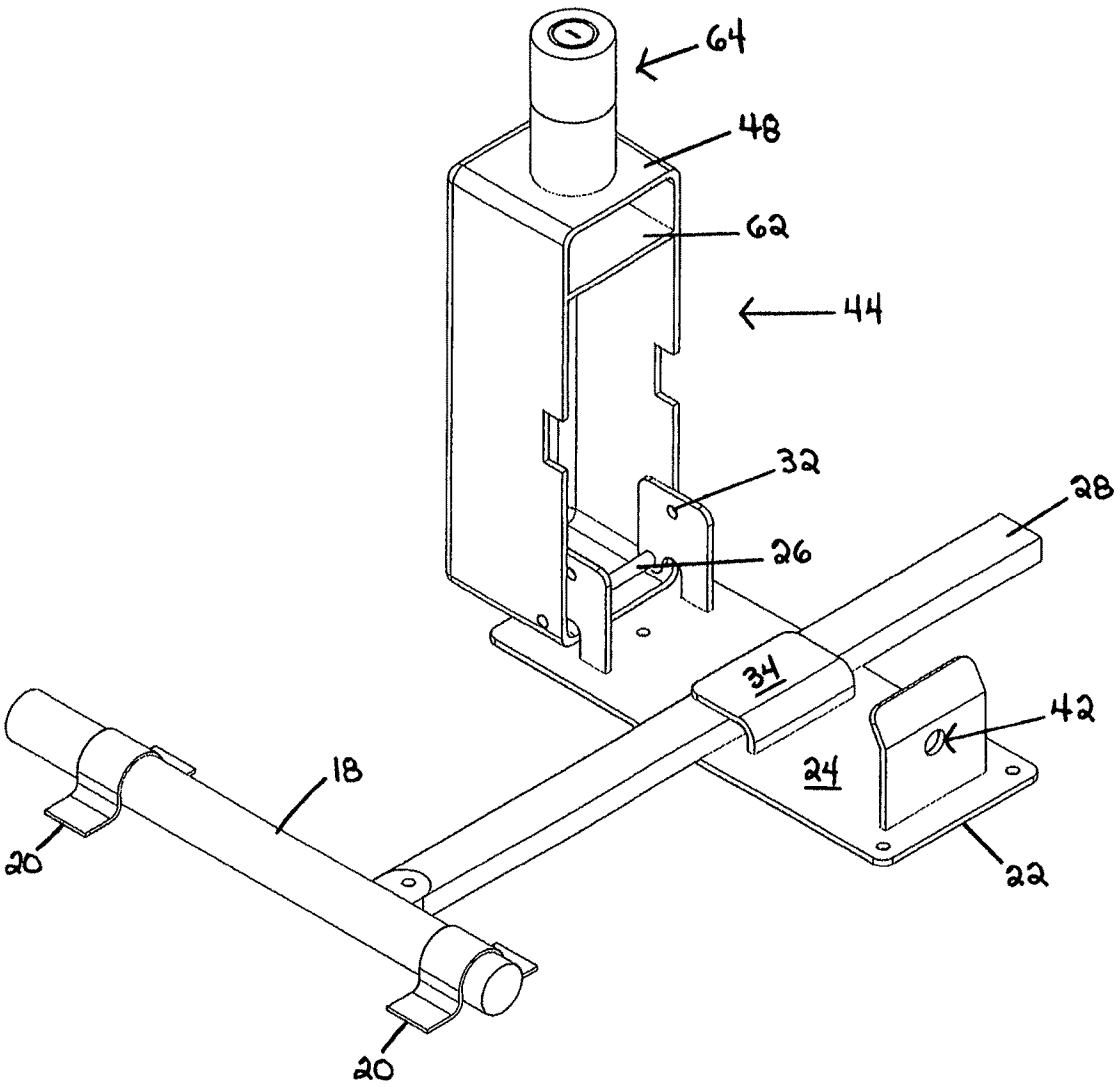
FIG. 5 is a perspective view of the security device in an unlocked position.

Referring to the drawings in greater detail and by reference characters thereto, there is illustrated a trailer which is generally designated by reference numeral 10 and which has a hitch assembly generally designated by reference numeral 12.

Trailer 10 also includes a door 14 to permit access to the interior of the trailer. Trailer 10 is also provided with a handle assembly generally designated by reference numeral 16. Handle assembly 16 includes a vertical rod 18 which is designed to lock trailer door 14 as is well known in the art. Rod 18 thus is designed to extend into and out of locking recesses in the frame of the trailer. Rod 18 includes a plurality of retainers 20.

Handle assembly 16 also includes a base plate 22 which has a top surface 24 which is of a slightly resilient material which has a rubber or plastic material for purposes which will become apparent hereinbelow.

The locking device includes a cover generally designated by reference numeral 44 which is designed to pivot about a hinge pin 26 to move into and out of engagement with top surface 24. When engaged with top surface 24, the slightly flexible material of the top surface 24 will seal cover 44 to prevent moisture entering therein.

Cover 44 is provided with a pair of embossments 30, 32 such that cover 44 can remain in an open position.

Mounted on base plate 22 is a hasp 34. Hasp 34 is designed to receive a handle member 20 which is connected to locking rod 18 to provide rotational movement thereof.

Also mounted on base plate 22 is a deflector 36 which has a perpendicular lower portion 40 and an angled upper portion 38. Provided within perpendicular lower portion 40 is an aperture 42 for reasons which will become apparent hereinbelow.

Cover 44 has a back wall 46, a front wall 48 and side walls 50, 54. Side wall 50 has a notch 52 formed in a lower portion thereof as does wall 54, which notch is designated by reference numeral 56. Cover 44 also has a front wall 48 and a top wall 60.

Extending between side walls 50, 54 is an intermediate transverse wall 62. A cavity is thus formed between front wall 48 and intermediate transverse wall 62 and which cavity is designed to receive deflector 36 when cover 44 is in the closed position.

The opening and closing of the cover is illustrated in FIGS. 10A to 10C and FIGS. 11A to 11C.

Figure 10A:
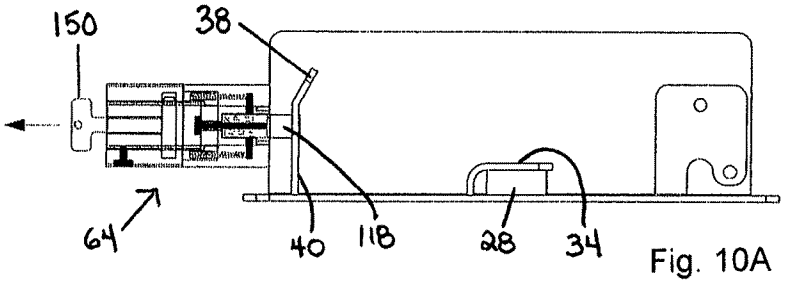
FIGS. 10A through 10C are side views, partially in section, of the opening of the security device.
Figure 10B:
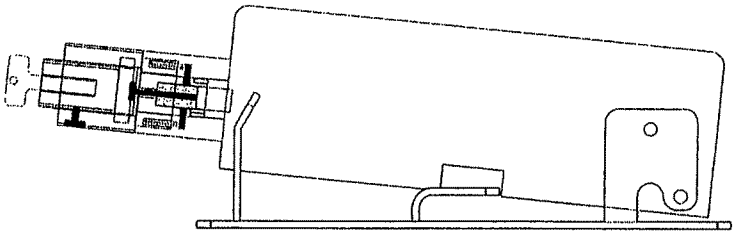
Figure 10C:
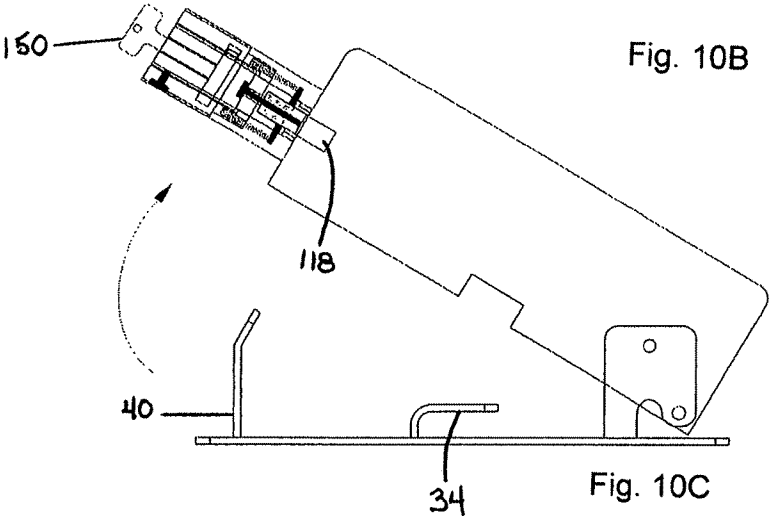
Figure 12:
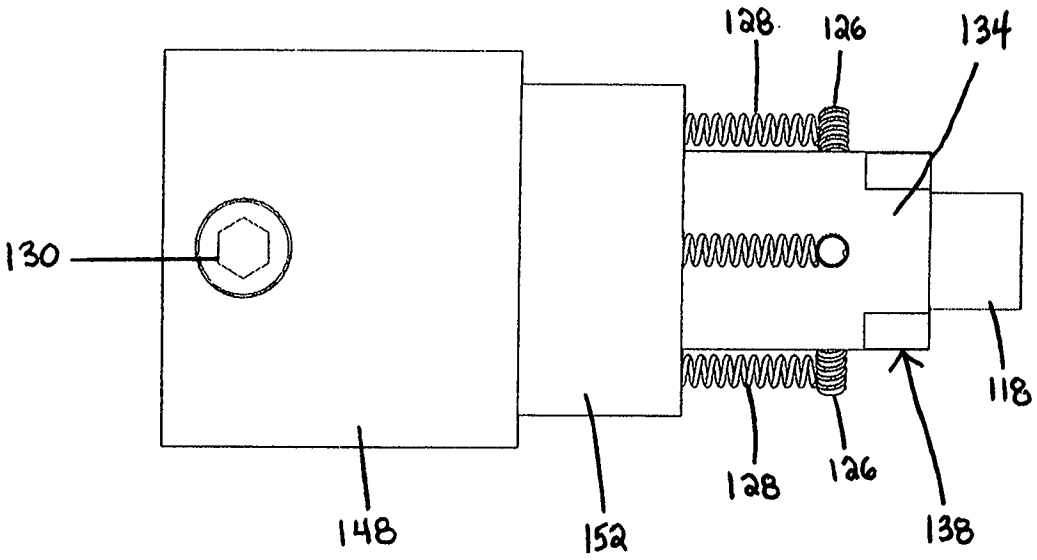
FIG. 12 is a side elevational view of the locking assembly of the security device.
Figure 13:
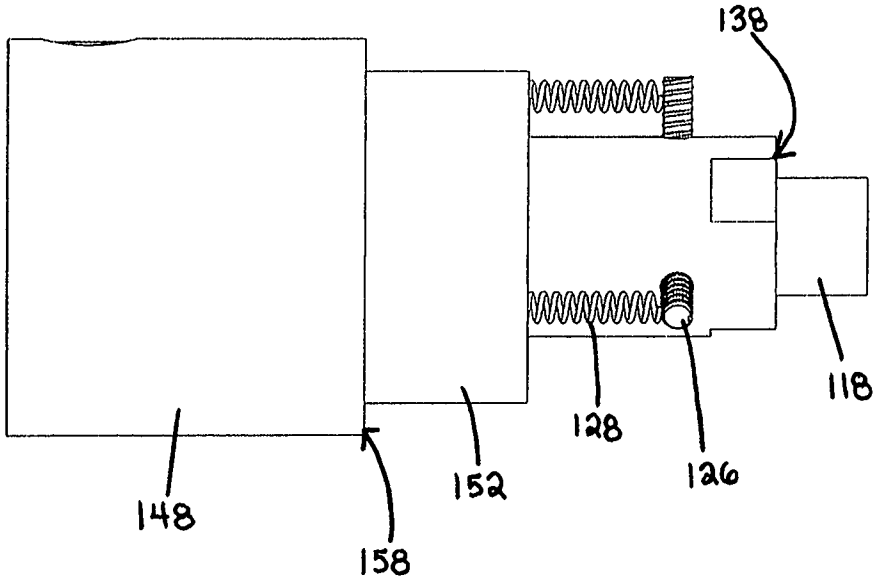
FIG. 13 is a further side elevational view of the locking assembly.
Figure 14:
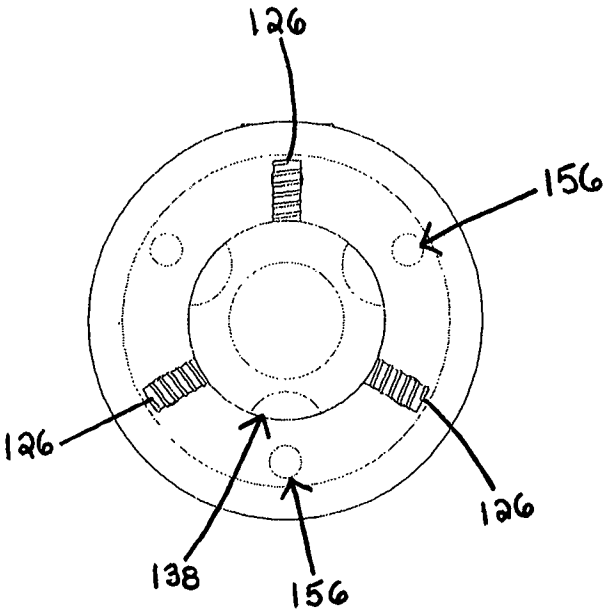
FIG. 14 is an end elevational view thereof.
Figure 15:
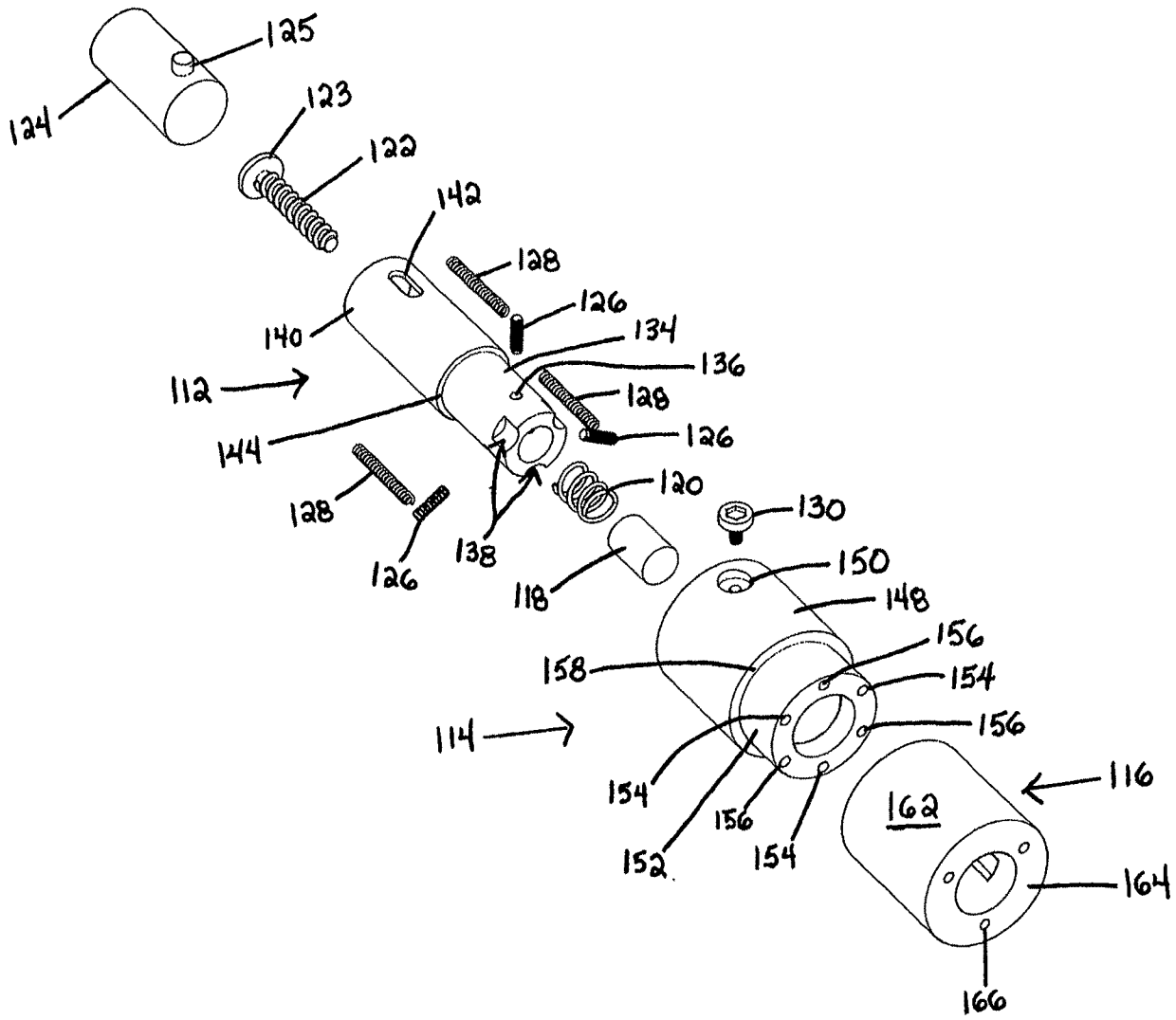
FIG. 15 is an exploded view of the locking assembly.
Figure 16:
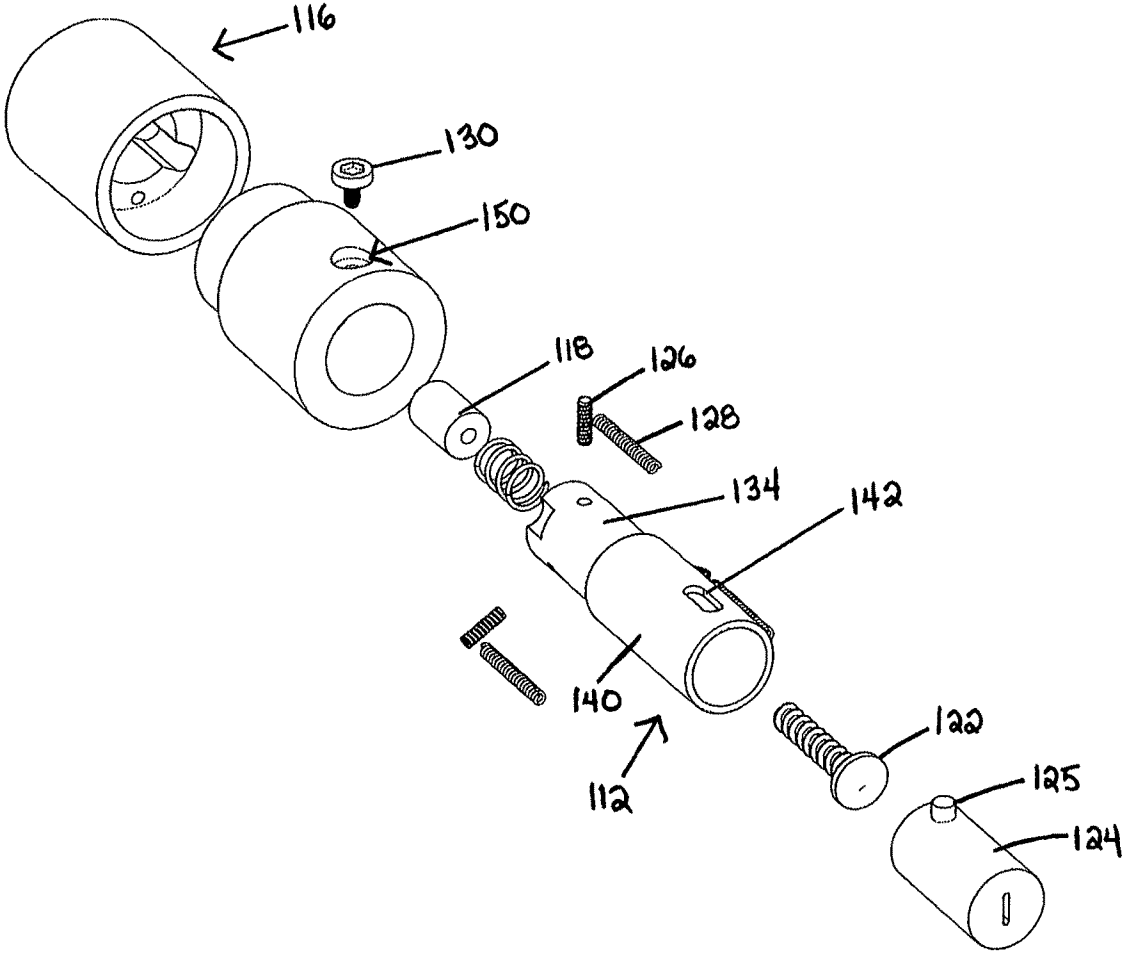
FIG. 16 is a further exploded view of the locking assembly.

In FIGS. 10A to 10C, key 150 is inserted in the key hole to cause plunger 118 to disengage from aperture 42 in deflector 36. The cover may then be lifted to expose hasp 34.

Figure 11A:
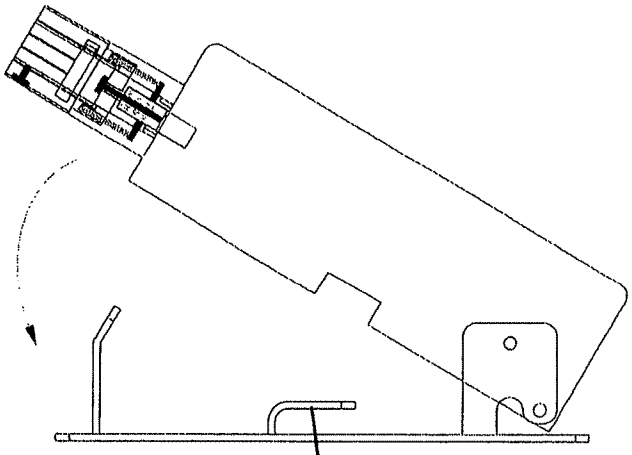
FIGS. 11A through 11C illustrate in sequence the closing of the security device.
Figure 11B:
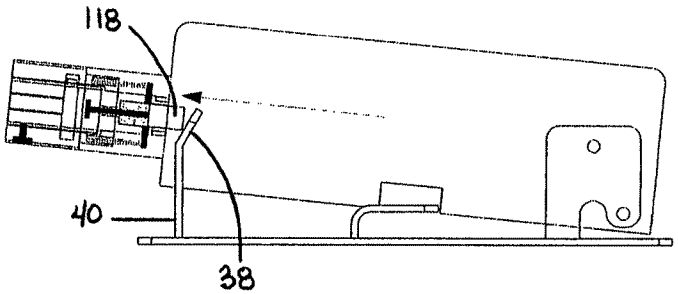
Figure 11C:
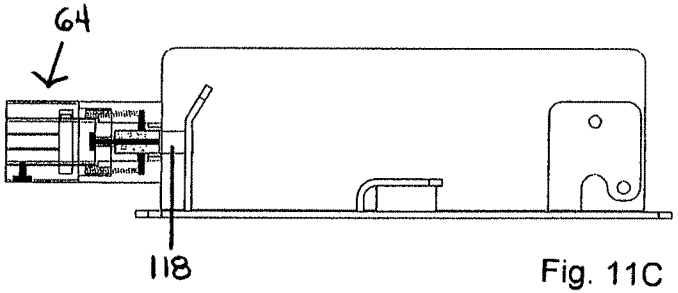

In closing, and as shown in FIGS. 11A to 11C, plunger 118 will engage with angled top portion 38 of deflector 36. As the motion is continued, plunger 118 will engage with aperture 42 to thereby lock the cover in place.

Reference will now be made to the lock assembly which is generally designated by reference numeral 110.

Lock assembly 110 includes an inner housing generally designated by reference numeral 112, an outer housing generally designated by reference numeral 114, and a cover generally designated by reference numeral 116.

Lock assembly 110 also includes a plunger 118 and a plunger biasing spring 120. Lock assembly 110 includes a screw 122 and a lock cylinder 124 which has a protrusion 125 extending radially outwardly.

Lock assembly 110 uses screws 126 (three being shown) and three coil springs 128. A screw 130 is provided for reasons which will be discussed hereinbelow.

Inner housing 112 has an upper portion 134 which has a plurality of threaded apertures. There are also provided recesses 138 formed in the side of upper portion 134. Inner housing 112 also includes a lower portion 140 which has a slot 142 formed therein. It will be noted that there is provided a shoulder 144 between upper portion 134 and lower portion 140.

Outer housing 114 has a lower portion 148 which has a threaded aperture 150 to receive screw 130. An upper portion 152 has a plurality (three) of threaded apertures formed in the end thereof. Interspersed between threaded apertures 154 are recesses 156. Again, a shoulder 158 is formed between lower portion 148 and upper portion 152.

Cover 116 has a cylindrical body 162 with an end wall 164 having recesses 166 formed therein. Recesses 166 are designed to allow screws 168 to pass therethrough.

Figure 6:
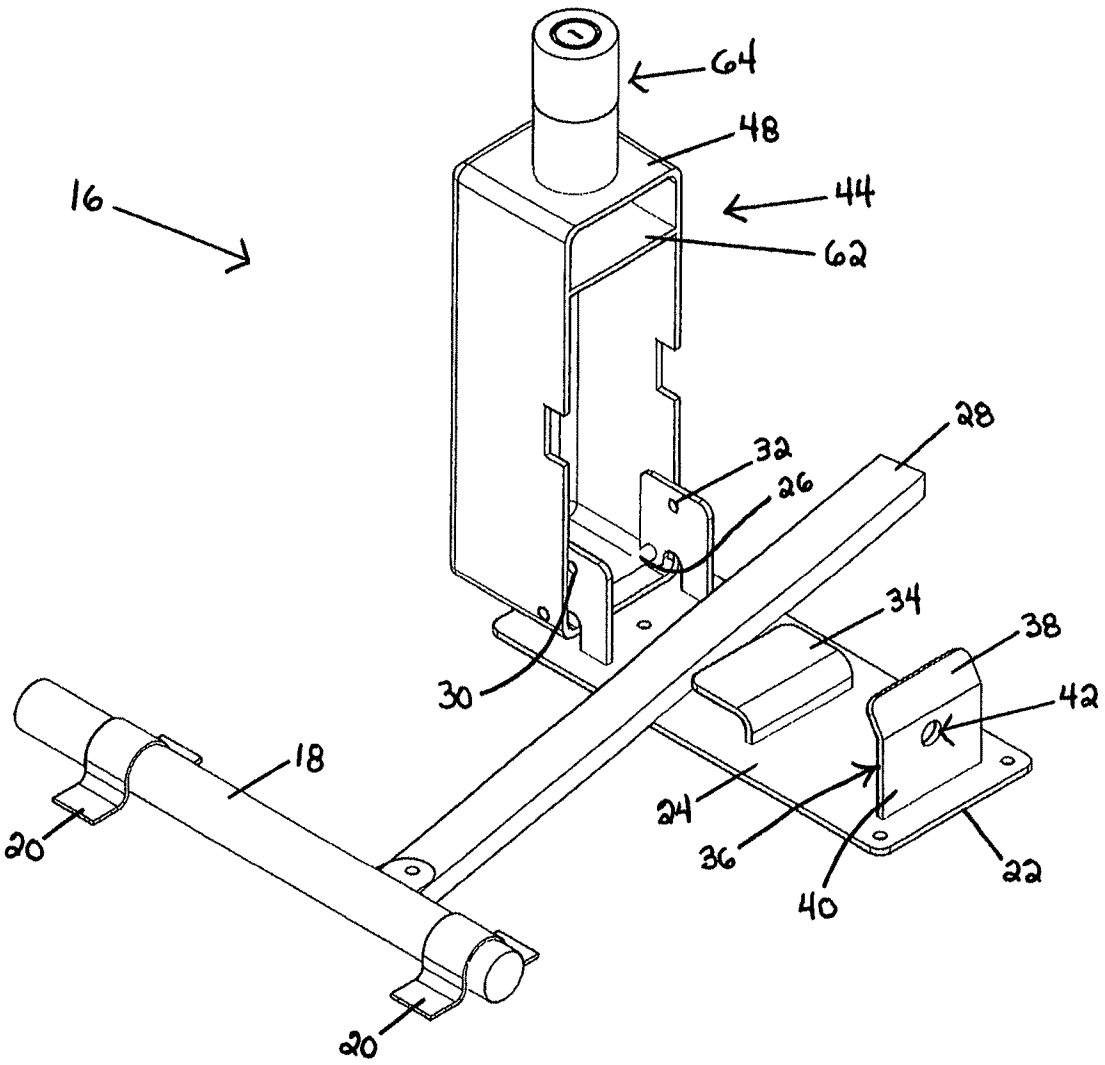
FIG. 6 is a perspective view of the security device as it is being opened.
Figure 7:
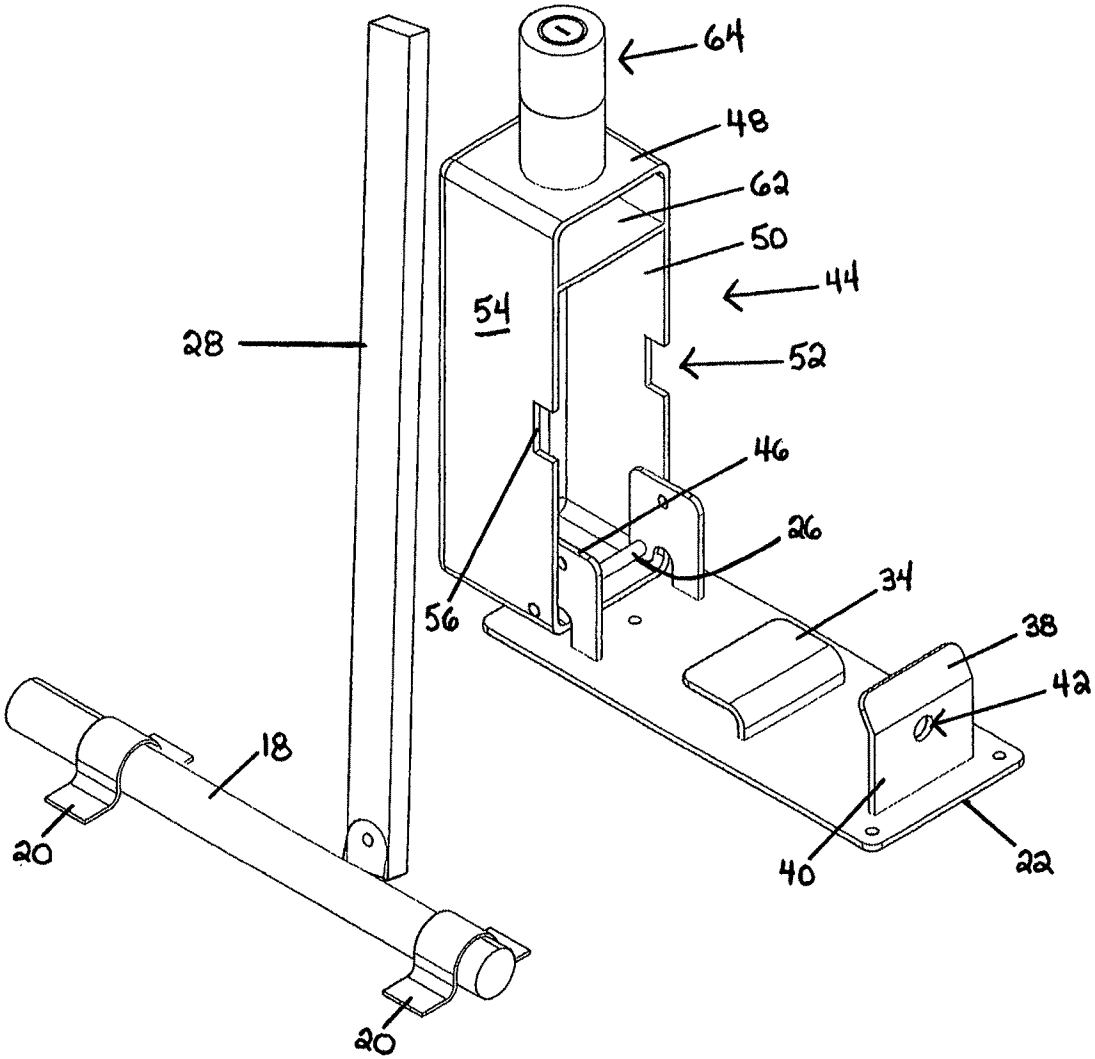
FIG. 7 is a perspective view of the security device in a fully opened position.
Figure 8:
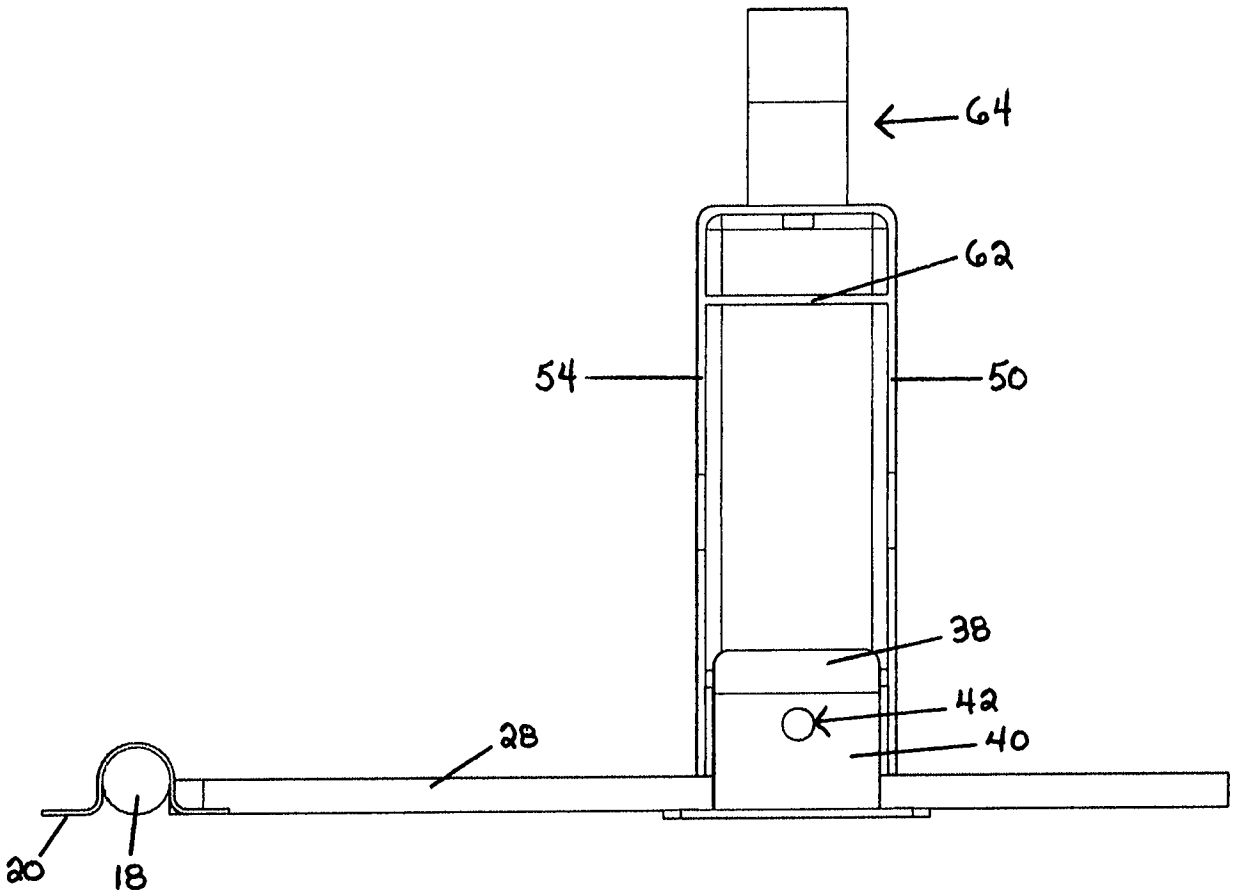
FIG. 8 is a front elevational view of the security device shown in FIG. 7.
Figure 9:
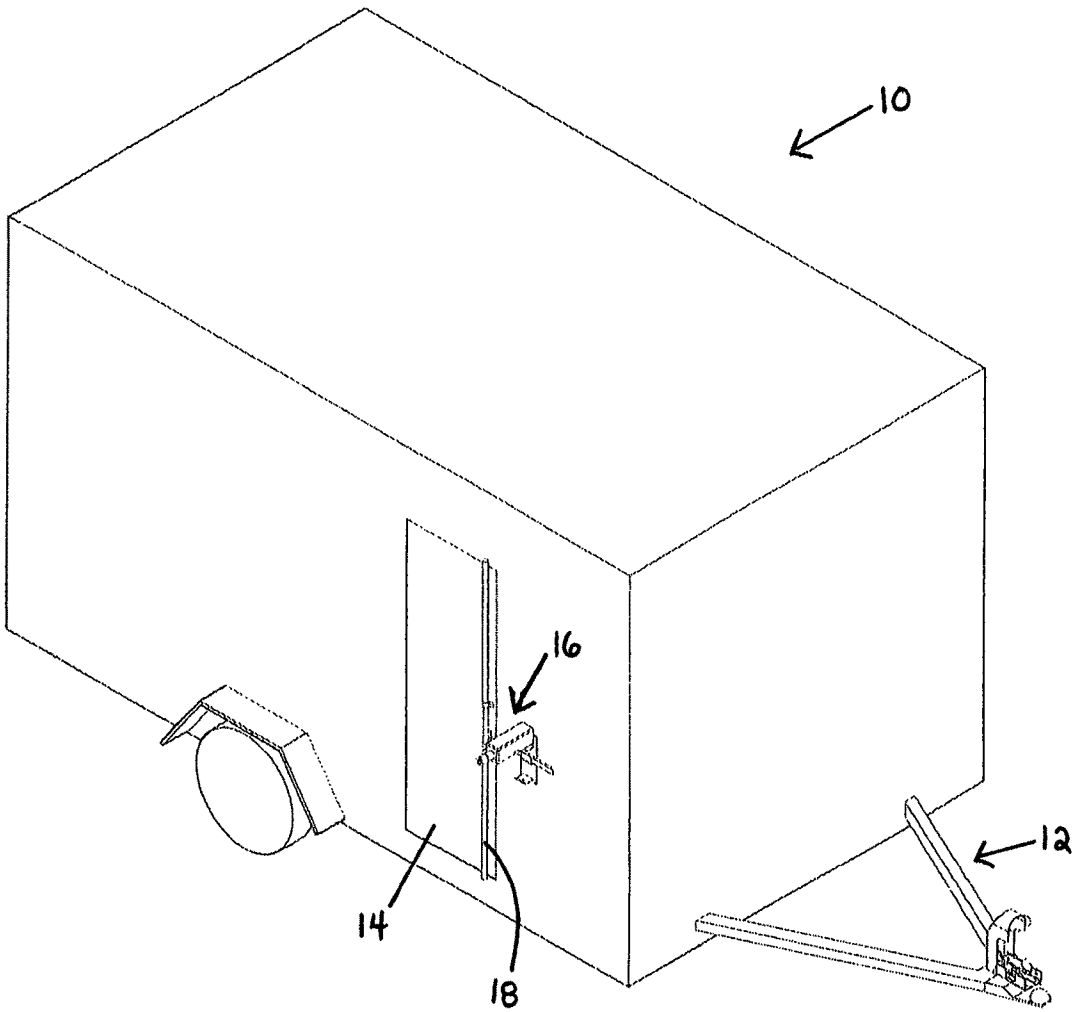
FIG. 9 is a perspective view of a trailer having the security device of the present invention.

As may be seen in FIGS. 6 and 7, lock assembly 110 is assembled such that screw 122 is screwthreadably engaged with plunger 118. Plunger spring 120 is biased between plunger 118 and the interior of upper portion 134 of inner housing 112. Screw head 123 abuts upper portion 134.

Inner housing 112 fits within outer housing 114 and the two housings are biased against each other by means of springs 128 abutting, at one end, screws 126 and recesses 156 in outer housing 114. As shown, screw 130 is engaged within slot 142 of inner housing 112. This limits the movement of inner housing 112 within outer housing 114.

Figure 17:
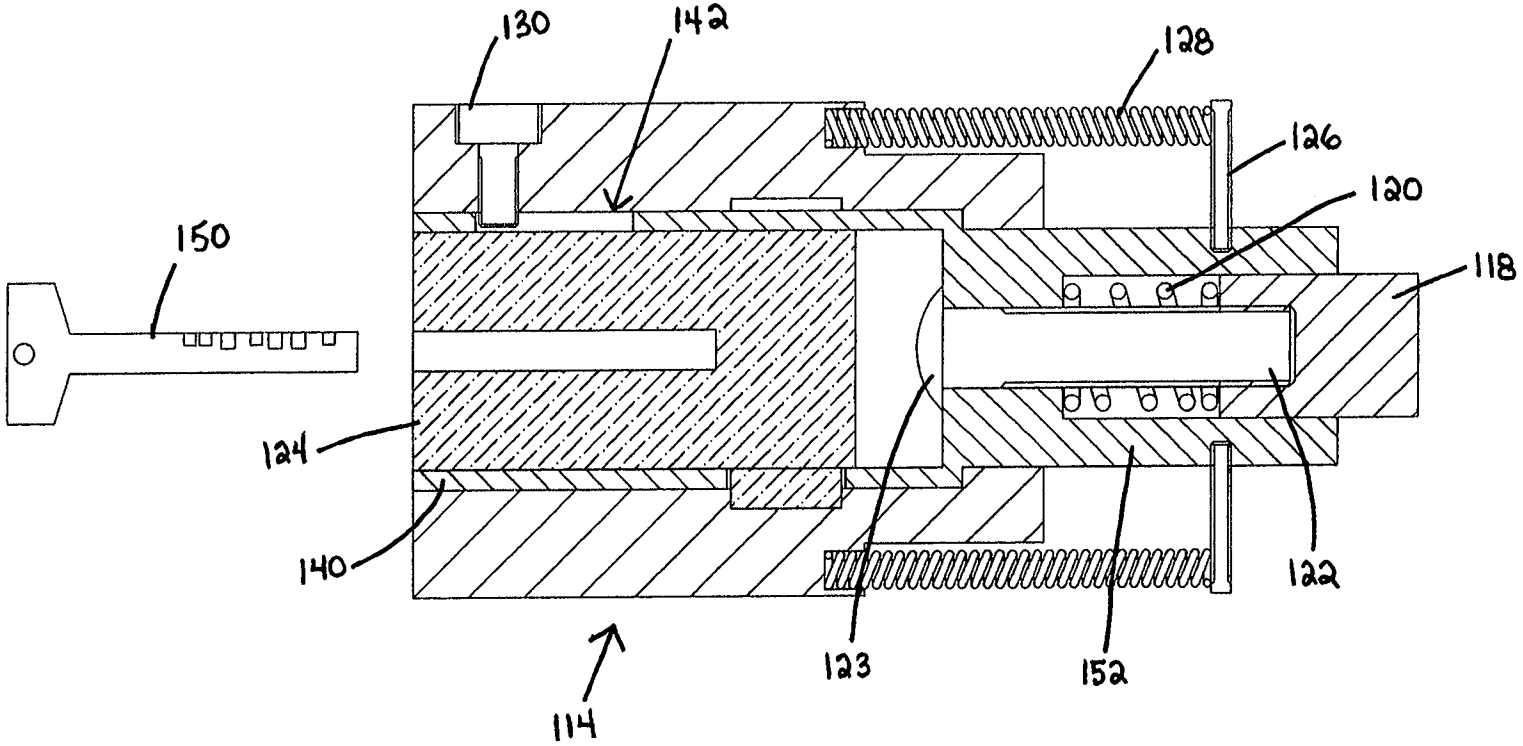
FIG. 17 is a side sectional view of the locking assembly in a locked position.
Figure 18:
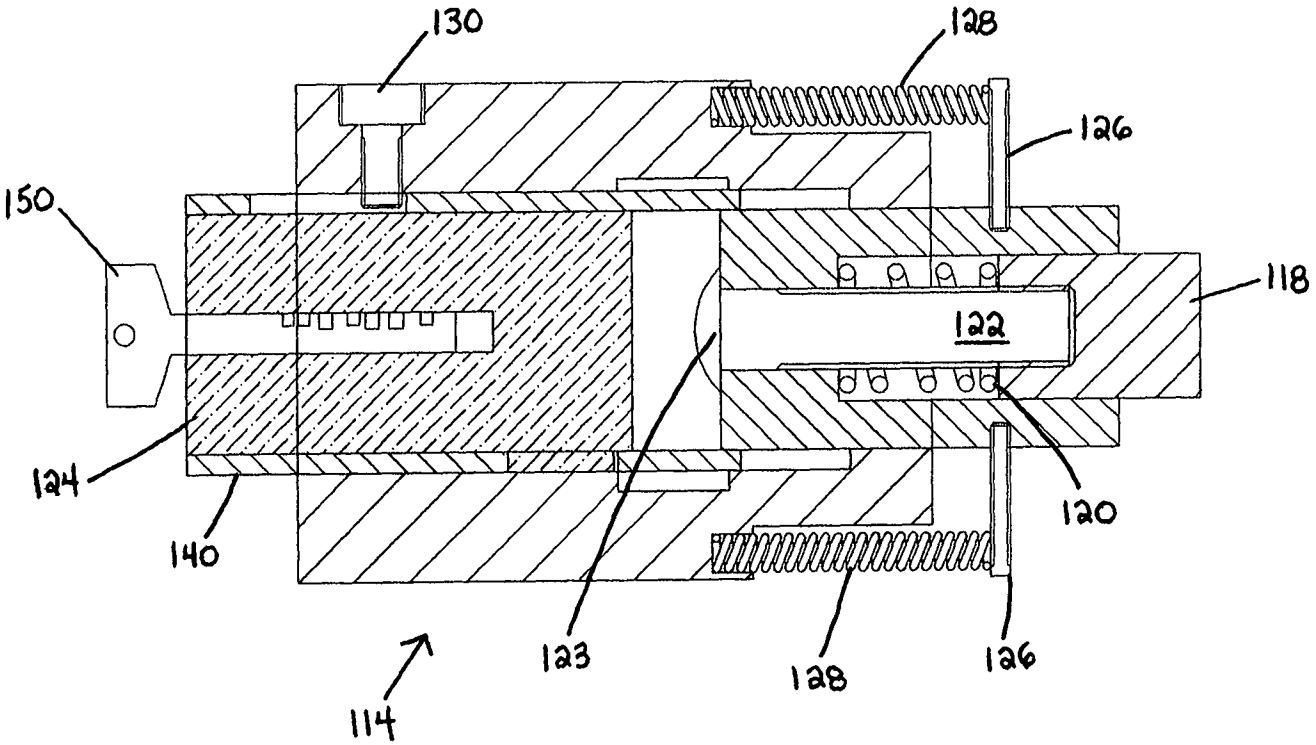
FIG. 18 is a cross-sectional view of the locking assembly in an unlocked position.

In operation, as may be seen in FIGS. 17 and 18, a key 150 may be inserted in lock cylinder 124. Rotation of the key will unlock the engagement of protrusion 125 from engagement with lower portion 148 of outer housing 114. However, protrusion 125 will still remain engaged with lower portion 140 of inner housing 112. Pulling on the key will cause outward movement of inner housing 112 with respect to outer housing 114. This retraction will also pull plunger 118 from engagement with an aperture in the device to thereby permit release of the plunger with the aperture. Removal of the key will then permit the device to still be locked according to the arrangement described above.

It will be understood that the above described embodiment is for purposes of illustration only and that changes and modifications may be made thereto without departing from the spirit and scope of the invention.

I claim:

1. A security device for a trailer door, said security device having a rotatable post for locking said door, a bar member attached to said post, said security device comprising:

a plate member for securement to a substrate;

a cover hingedly connected to said plate member and movable between an open and closed position;

a locking device mounted at one end of said cover, said locking device having a housing, said housing having a pair of side walls, a front wall, a rear wall and a top wall, a plunger mounted within said housing, said plunger being movable between an extended position and a retracted position, said plunger being spring biased to said extended position; and a deflector extending upwardly from said plate member, said deflector having an aperture formed therein, said deflector being located such that said plunger will contact said deflector when said cover is moved to a closed position, said deflector causing said plunger to initially retract and subsequently extend when said plunger is aligned with said aperture in said deflector.

2. The security device of claim 1 wherein said cover has an interior wall spaced from said front wall to form a compartment, a sealing member on said plate member, said sealing member sealing said compartment to reduce moisture entry thereto.

3. The security device of claim 1 wherein said lock is a key operated push-pull lock.

4. The security device of claim 1 wherein each of said side walls has aligned slots formed therein, said slots being located at a free marginal edge of said side walls and being designed to receive said bar member.

5. The security device of claim 4 wherein said cover is formed of a stainless steel material.

* * * * *